US006578543B2

(12) United States Patent
Radel

(10) Patent No.: US 6,578,543 B2
(45) Date of Patent: Jun. 17, 2003

(54) MOTOR INTAKE CHAMBER

(75) Inventor: Harry Radel, Geesthacht (DE)

(73) Assignee: Dolmar GmbH, Hamburg (DE)

( * ) Notice: Subject to any disclaimer, the term of this patent is extended or adjusted under 35 U.S.C. 154(b) by 0 days.

(21) Appl. No.: 10/016,083

(22) Filed: Dec. 12, 2001

(65) Prior Publication Data

US 2002/0088421 A1 Jul. 11, 2002

(30) Foreign Application Priority Data

Dec. 13, 2000 (DE) ..... 200 21 316

(51) Int. Cl.[7] ..... F02M 35/10
(52) U.S. Cl. ..... 123/198 E; 123/184.21
(58) Field of Search ..... 123/198 E, 184.21

(56) References Cited

U.S. PATENT DOCUMENTS

| | | | | |
|---|---|---|---|---|
| 5,269,665 A | * 12/1993 | Sadler et al. | ..... | 123/198 E |
| 5,363,815 A | * 11/1994 | Pretzsch et al. | ..... | 123/198 E |
| 5,367,988 A | * 11/1994 | Collins | ..... | 123/198 E |
| 5,687,689 A | * 11/1997 | Santos | ..... | 123/198 E |
| 6,187,073 B1 | * 2/2001 | Gieseke et al. | ..... | 123/198 E |
| 6,309,436 B1 | * 10/2001 | Holch | ..... | 123/198 E |
| 6,391,073 B1 | * 5/2002 | Koga | ..... | 123/198 E |

* cited by examiner

*Primary Examiner*—Tony M. Argenbright
*Assistant Examiner*—Jason Benton

(57) ABSTRACT

This invention relates to a motor intake chamber, especially for a chain saw, with a novel opening for removing impurities that may be deposited on an air filter from the intake chamber. The intake chamber also includes a flap closing the opening for sound damping, which flap is closed during motor load operation.

6 Claims, 1 Drawing Sheet

MOTOR INTAKE CHAMBER

FIELD OF THE INVENTION

This application claims priority from Federal Republic of Germany application 200 21 316.4, and the entire contents of same are incorporated herein by reference.

The present invention relates to a motor intake chamber, in particular a chain saw with an intake opening and an air filter.

BACKGROUND OF THE INVENTION

When internal combustion motors are used, an intake chamber is frequently put in front of the motor and is used to prepare (e.g., compress and clean) the combustion air of the motor. The air drawn in for the motor can be loaded to a high degree with particles, especially when a motor is used in a heavily contaminated environment.

In known intake chambers, a suitable preparation of air is provided, for example, via pre-cleaning the air in accordance with the cyclone principle, that is, by a centrifugal separation or the use of filters inside the intake chamber. A separation of particles inside the intake chamber takes place thereby. This results in an increased requirement for maintenance of the intake chamber in order to prevent problems with other motor components such as, e.g., the carburetor, which is connected in downstream according to fluid technology.

SUMMARY OF THE INVENTION

The invention therefore addresses the need for an intake chamber that makes possible a simple and at least partially automatic removal of deposits from a motor intake chamber, is simple as regards its design, manufacturing steps and mounting and consists of as few individual parts as possible in order to reduce the expense of manufacturing and mounting.

The invention solves the problem posed in that the motor intake chamber has another opening for removing impurities separated on the air filter and, in addition, a flap that closes the opening and is closed during motor load operation. It is possible, on account of the features of the invention, that deposits deposited in the intake chamber can exit through the additional opening out of the intake chamber and at the same time a sufficient sound damping is assured by the closing of the flap in motor load operation.

DETAILED DESCRIPTION OF THE PREFERRED EMBODIMENTS

Figure 1:
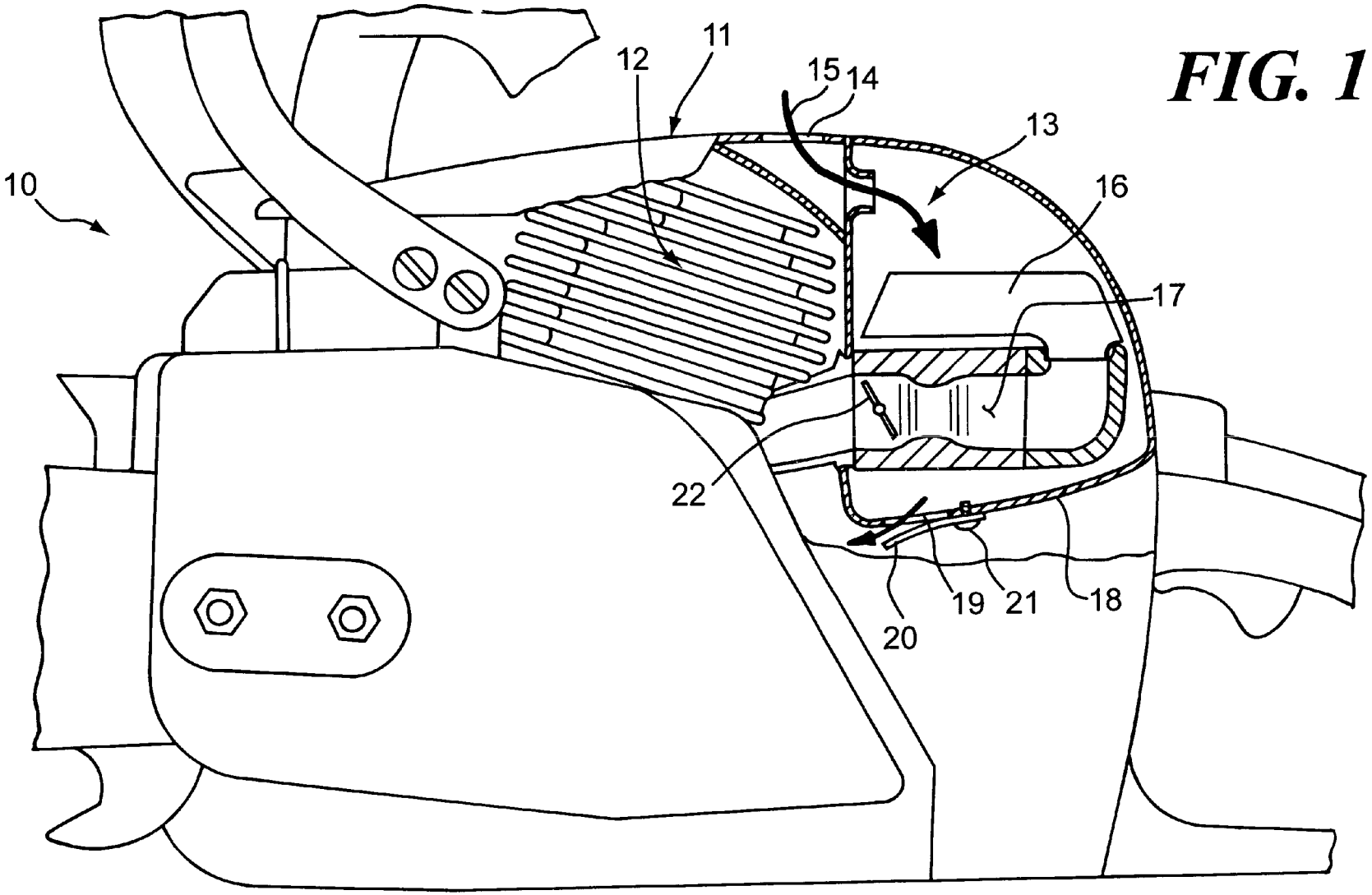
FIG. 1 shows a preferred embodiment of the invention in the form of a chainsaw.

This invention entails a motor intake chamber that has an intake opening and an air filter, characterized by another opening for removing impurities deposited on the air filter from the intake chamber. The motor intake chamber may also have a flap closing the opening for sound damping, which flap is closed during motor load operation.

According to a preferred embodiment of the invention the flap is moved during motor load operation by a vacuum prevailing in the intake chamber into a position in which the flap closes the additional opening. This avoids an additional closing mechanism.

According to an especially advantageous embodiment of the invention the flap is a pre-tensioned into the open position so that the impurities can fall out.

The flap of the motor intake chamber of the invention is preferably manufactured from an elastic material.

According to an advantageous embodiment the flap is located on the bottom of the intake chamber in order that separated impurities fall out by themselves.

The intake-chamber flap in accordance with the invention is preferably fastened to the chamber by a hinge.

An exemplary embodiment of the invention is explained below with reference made to the single drawing, FIG. 1. The invention is described using the example of a chain saw.

FIG. 1 shows a chain saw 10 with motor housing 11 surrounding internal combustion motor 12. In addition, motor housing 11 surrounds intake chamber 13 into which the air required for combustion is drawn during the operation of motor 12. The combustion air flows through intake opening 14 into intake chamber 13, as indicated by arrow 15 in FIG. 1.

Especially in the case of chain saws, the aspirated combustion air is most likely loaded with solid impurities such as, e.g., wood chips, but also with liquid impurities. In order to protect the motor from such chips or other impurities in the air, air filter 16 preceded by carburetor 17 is located in intake chamber 13. The combustion air aspirated by motor 12 is filtered by air filter 16, during which the chips or other particles are separated on the filter and collect in the lower area of intake chamber 13.

Opening 19 and flap 20 fastened to the bottom are located in bottom 18 of intake chamber 13. Flap 20 is fastened by fastening means 21 to bottom 18 in such a manner that it opens outward. Fastening means 21 can be screws or hinges. Flap 20 is attached above opening 19 and can close it completely. In a preferred exemplary embodiment flap 20 consists of an elastic rubber material. However, it can consist of any material whatsoever, e.g., of a metal plate attached to bottom 18 in such a manner that it can pivot by a hinge.

When the motor is turned off or is idling, flap 20 is open, that is, opening 19 is free. In this open position deposits, e.g., chips from intake chamber 13 can exit and fall out into the environment through opening 19 on bottom 18.

On the other hand, if the motor of chain saw 10 is in load operation, throttle 22 of a carburetor is open. A vacuum is produced in intake chamber 13 that causes flap 20 to close opening 19. A vacuum of approximately 10 hPa prevails thereby in intake chamber 13, which vacuum brings about sufficient exertion of force on flap 20 to reliably close opening 19.

As a result thereof, the sound-damping action of intake chamber 13 is assured during the load operation. On the other hand, this sound-damping function is not required in idling operation. Since no vacuum or at least a significantly lesser vacuum prevails in intake chamber 13 during idling, flap 20 is in the open position thereby so that the chips can fall out of intake chamber 13 again thus be removed between a tank chamber (not shown) and intake chamber 13.

Although motor intake chamber 13 was described using chain saw 10, an intake chamber 13 designed in accordance with the invention can also be used in other motor-driven devices such as motorized scythes, floor-cleaning devices, leaf blowers, high-pressure cleaners, etc. without leaving the concept of the invention.

What is claimed is:

1. A motor intake chamber comprising an intake opening, an air filter, a second opening, and a flap which is positioned to releasably close the second opening and which is pretensioned into the open position, wherein impurities deposited on the air filter from the intake chamber are eliminated via the second opening, and wherein the flap is closed during motor load operation.

2. The motor intake chamber according to claim 1, which is adapted for a chain saw.

3. The motor intake chamber according to claim 1, characterized in that the flap is brought into a closed position over the second opening during motor load operation by a vacuum prevailing in the intake chamber.

4. The motor intake chamber according to claim 1, characterized in that the flap comprises an elastic material.

5. The motor intake chamber according to claim 1, characterized in that the flap is located on the bottom of the intake chamber.

6. The motor intake chamber according to claim 1, characterized in that the flap is fastened to the chamber by a hinge.

* * * * *